US005195745A

United States Patent [19]

Rudell et al.

[11] Patent Number: 5,195,745

[45] Date of Patent: Mar. 23, 1993

[54] THROWING PROJECTILES AND THROWING AIDS THEREFOR

[76] Inventors: Elliot Rudell, 1619 Gramercy St., Torrance, Calif. 90501; George T. Foster, 2700 Panorama Dr. #404, Signal Hill, Calif. 90806

[21] Appl. No.: 743,758

[22] Filed: Aug. 12, 1991

[51] Int. Cl.[5] ..... A63B 43/00; A63B 65/12

[52] U.S. Cl. ..... 273/65 EG; 273/58 K; 273/346; 273/DIG. 30; 124/79

[58] Field of Search ..... 273/64, 65 R, 65 EF, 273/65 EG, 58 K, 346, 453, DIG. 30, 412, 424, 425, 426, 427, 428; 124/79

[56] References Cited

U.S. PATENT DOCUMENTS

| | | | |
|---|---|---|---|
| 934,812 | 9/1909 | Hughes | 124/79 |
| 2,011,760 | 8/1935 | Gallinant | 273/58 K X |
| 3,032,345 | 5/1962 | Lemelson | 273/346 |
| 3,095,867 | 7/1963 | Kiyuna | 273/428 X |
| 3,208,749 | 9/1965 | Skuse | 273/64 X |
| 3,628,794 | 12/1971 | Conture | 124/79 X |
| 3,857,566 | 12/1974 | Lemelson et al. | 273/346 |
| 3,917,271 | 11/1985 | Lemelson et al. | 273/346 |
| 3,927,881 | 12/1975 | Lemelson et al. | 273/DIG. 30 X |
| 3,953,030 | 4/1976 | Muchnick | 273/412 X |
| 3,999,748 | 12/1976 | Clarke | 273/346 |
| 4,235,042 | 11/1980 | Hills | 273/DIG. 30 X |
| 4,447,060 | 5/1984 | Guinn | 273/346 |
| 4,684,127 | 8/1987 | Rudell | 273/453 |
| 4,887,814 | 12/1989 | Winter | 273/58 K X |
| 4,938,487 | 7/1990 | Ponsart | 273/64 X |
| 4,995,617 | 2/1991 | Lee | 273/346 |
| 5,133,550 | 7/1992 | Handy | 273/58 K X |

*Primary Examiner*—William H. Grieb
*Attorney, Agent, or Firm*—Plante, Strauss & Vanderburgh

[57] ABSTRACT

There is disclosed a modified throwing object, such as a modified football or frisbee, and a corresponding glove or wrist strap or finger-band worn by each player. Both the object and the gloves or wrist strap or finger-band are covered with coacting elements which are preferably a limited amount of the material comonly called velcro. This material attaches to itself by its well-known design of fabric hook pieces gripping onto fabric loop pieces. The invention is so designed that then the object is held in a typical throwing position, prior to being thrown, there is interaction between the velcro on the glove and the velcro on the object. Upon release of the object during a throw, the bond between the velcro on the object and that on the glove, wrist or finger of the thrower is separated with a slight difficulty, thereby casuing the object to spin as it leaves the thrower's hand. This spinning of the object on its longitudinal provides the desired spiraling action that greatly enhances the accuracy and speed of an object such as a football as it travels through the air, or the spinning action which improves the distance and accuracy of a frisbee.

29 Claims, 8 Drawing Sheets 44
42
90
86
88
92
94
84

Fig. 11
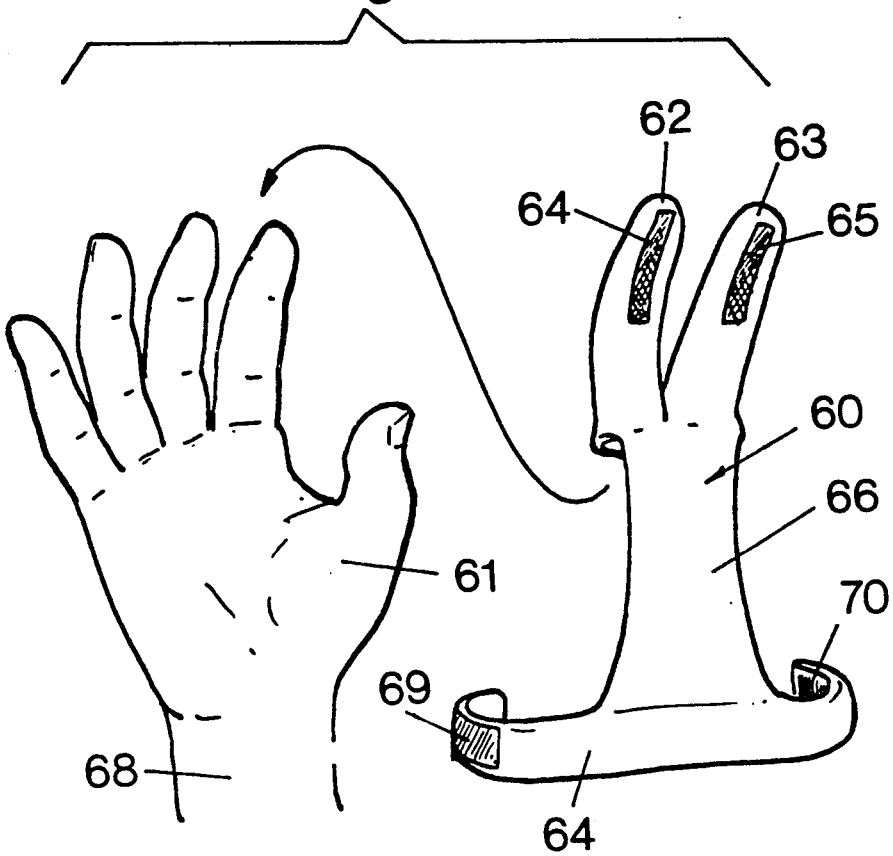
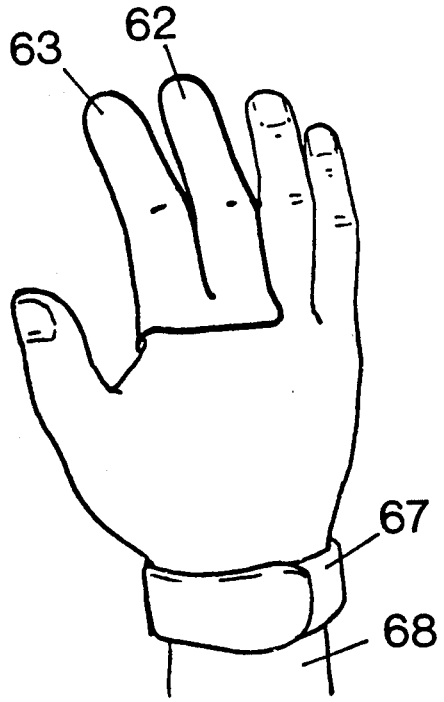
Fig. 12
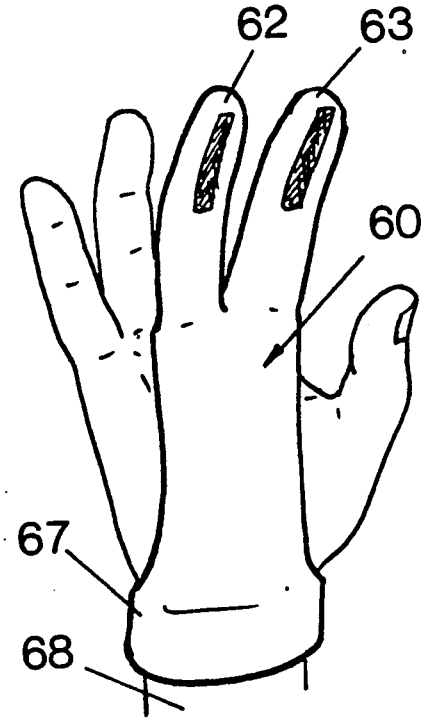
Fig. 13

THROWING PROJECTILES AND THROWING AIDS THEREFOR

FIELD OF THE INVENTION

This invention relates to sports in which it is necessary to impart a spin to a thrown object such as a football or a toy flying disc such as is commonly referred to by the tradename Frisbee, and particularly to a variation in the design of the surface of the object which is thrown in combination with an additional element of this invention, provides superior throwing capabilities for all age range of participants, particularly those first learning how to throw the object who might otherwise have difficulty causing the object to spiral.

DESCRIPTION OF THE PRIOR ART

The effective throwing of an object such as a football or Frisbee has always been considered somewhat of an art. It is necessary to release the object from the thrower's hand in a manner which imparts a spiraling or spinning motion to the object. The spinning of the object as it travels through the air causes its flight to be directionally controllable and straight. Children experience the greatest difficulty in imparting a spin to an object, particularly when throwing a football or a Frisbee.

The most notable prior art effort to improve performance of throwing a football is currently being marketed by Parker Brothers, a Division of Tonka Corporation. The product is called NERF TURBO FOOTBALL, and is basically a toy football molded of soft foam with fluted ribs extending longitudinally from end to end. These ribs affect the aerodynamics of the object and result in a somewhat better flight pattern, if the child can master the throw. The ribs, however, make the object look noticeably strange. Parker Brothers and many other toy companies also market soft foam footballs with no surface variations. These soft foam objects are easier to throw and catch by youngsters due to their tactile feel and softness.

The employment of VELCRO on projectiles such as balls, to assist catching, is a common-place occurrence. This necessarily requires significant amounts of VELCRO to be employed. A former St. Louis Manufacturer, Impulse, Ltd., marketed combinations of children's baseballs and gloves, footballs and gloves, and flying discs and gloves wherein the entire surface of each of the items, as well as significant areas of the gloves, were covered in the hook and loop material identified with the registered trademark VELCRO, to enable the users to catch the items better. The purpose of these items was to improve catchability. It was impossible to throw and thereby release the projectile once attached to the gloves due to the inherent nature of the design. The VELCRO firmly locked the objects to every surface of the gloves.

A company in Walnut, Calif. called Mantae America, Inc. is currently marketing a product called GRIP BALL comprising a rigid, hand-held plastic disc approximately 8 inches in diameter that bears one flat face surface fully covered by VELCRO material. It is intended that the wearer position said flat surface in the path of a VELCRO or napped-fabric covered ball to catch the ball securely in mid-flight. This product is covered under U.S. Pat. No. 4,995,617. It is apparent by the inherent design as well as the significant amount of coacting surface area, that this toy cannot be used to release a projectile in a manner as to achieve a controlled spiral. This toy, as well as all the other prior art, employ significant amounts of coacting material surfaces to ensure positive adherence for secure catching.

The invention disclosed in this application requires only minimal amounts of VELCRO material to achieve its spiraling results. Greater amounts, such as are required for projectile catching toys, is neither required nor desired. This differs significantly from all prior art.

Lemelson U.S. Pat. No. 3,032,345 describes a target game wherein VELCRO is mounted on the surface of a projectile dart to effect its adherence to a compatibly equipped target area. Other Lemelson U.S. Pat. Nos. 3,927,881, 3,857,566 and 3,917,271 also describe the employment of VELCRO for the purposes of adhering a projectile to a target surface. Guinn, U.S. Pat. No. 4,447,060, also describes a target game wherein the adherence of the projectile to the target is effected by the VELCRO.

One of the inventors in this application is a co-patentee of U.S. Pat. No. 4,684,127, a game in which tether straps are worn by multiple players and the VELCRO attachment provides a controlled break-away feature that causes players to release their grip from each other.

In no prior art has it been disclosed to employ VELCRO in a controlled manner both on the projectile and at the disposal of the players, in a manner such as a glove or wrist worn strap, to effect the motion of a projectile as it leaves the grip of the thrower. All of the prior art relative to thrown objects has utilized VELCRO to secure a thrown object to a solid surface.

OBJECTIVES OF THE INVENTION

It is an objective of this invention to provide an object for throwing such as a FRISBEE or a football for use by all players, particularly children, that is easier to throw and control.

It is also the objective of this invention to provide a FRISBEE or a football for use by all players, particularly children, that will spiral through the air and therefore travel straighter, and with greater velocity.

It is also an objective of this invention to provide FRISBEE or football throwers with a glove or a wrist worn strap or a finger-worn VELCRO band that interacts with the special FRISBEE or football of this invention to improve the throw and control of the thrown object.

Other and related objectives will be apparent from the following description of the invention.

BRIEF STATEMENT OF THE INVENTION

This invention comprises a special football or FRISBEE, and a corresponding glove or wrist strap or finger-band worn by each player. Both the object, be it a football or FRISBEE, and the gloves or wrist strap or finger-band are covered with a limited amount of the material commonly called VELCRO. The invention is so designed that when the object is held in typical fashion prior to being thrown, there is interaction between the VELCRO on the glove and the VELCRO on the object. Upon release of the object during a throw, the bond between the VELCRO on the object and that on the glove or wrist strap or finger band of the thrower is separated with a slight difficulty, thereby causing the object to spin as it leaves the thrower's hand. This spinning of the object on its longitudinal axis provides the desired spiraling action that greatly enhances the accuracy and speed of the object as it travels through the air.

BRIEF DESCRIPTION OF THE DRAWINGS

FIG. 11 illustrates the application of a partial glove for the invention;

FIGS. 12 and 13 illustrate the partial glove on a wearer's hand;

DESCRIPTION OF PREFERRED EMBODIMENT

Figure 1:
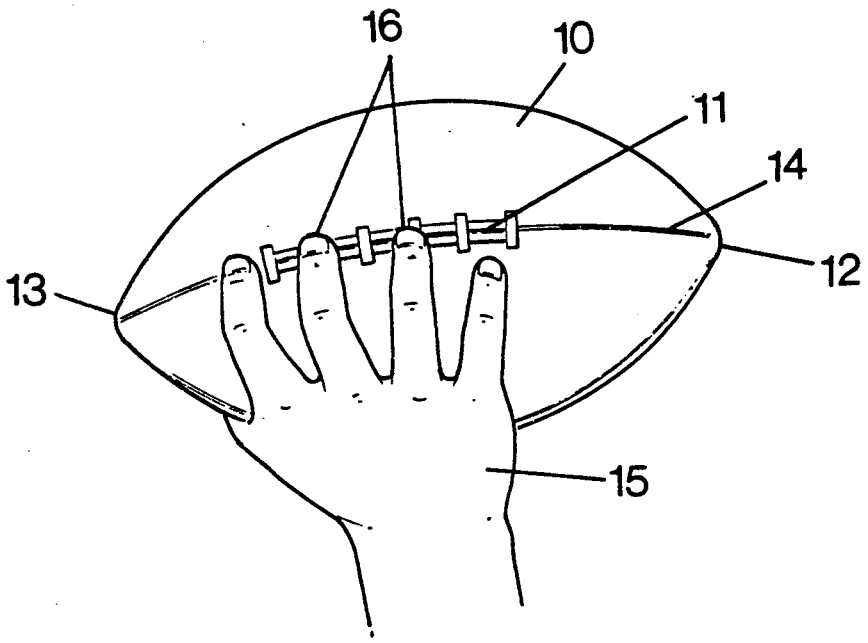
FIG. 1 illustrates a football as it is typically held by a thrower.

Referring now to FIG. 1, a typical American football 10 is illustrated. The object is a pointed ovaloid with round cross section, with its greatest length from end 12 to end 13. The football has either longitudinal seams stitched by threads 14, or, in the case of toy objects, molded, threaded seams. The thrower typically grasps the object in the manner shown, with several fingertips 16 resting on or over the lacing 11, which in the case of toy footballs is also molded into the surface of the football.

Figure 2:
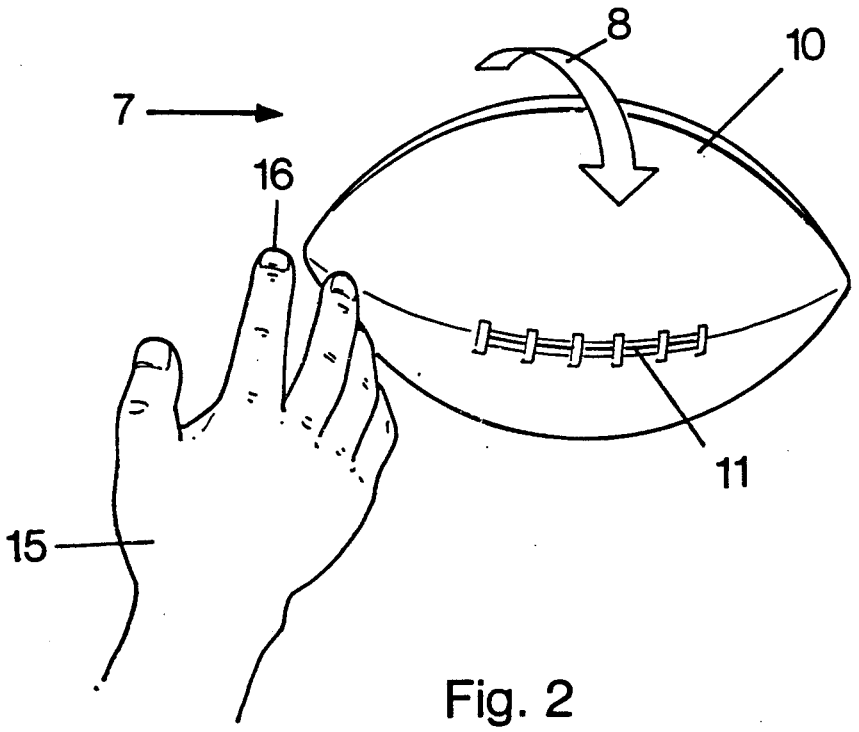
FIG. 2 illustrates a typical throw of a football.

Referring now to FIG. 2, the path of the object 10 is illustrated as released by the thrower. As the thrower's hand 15 moves forward (illustrated by arrow 7), the object 10 is released and the thrower's fingers 16 interact with the lacing 11, effecting a spiral motion of the object 10, as illustrated by arrow 8. This spiralling motion causes the object to travel straight, and with greater velocity. This effect is similar to the rifling inside a gun barrel which causes a bullet to travel accurately.

The skill required to release a conventional football in such a manner as described herein is acquired with difficulty, and can often be frustrating to a thrower. Children in particular often experience great difficulty with this skill. Even professional quarterbacks often release a football in less than the perfect manner as described herein; the result being a non-spiral, wobbly throw.

Figure 3:
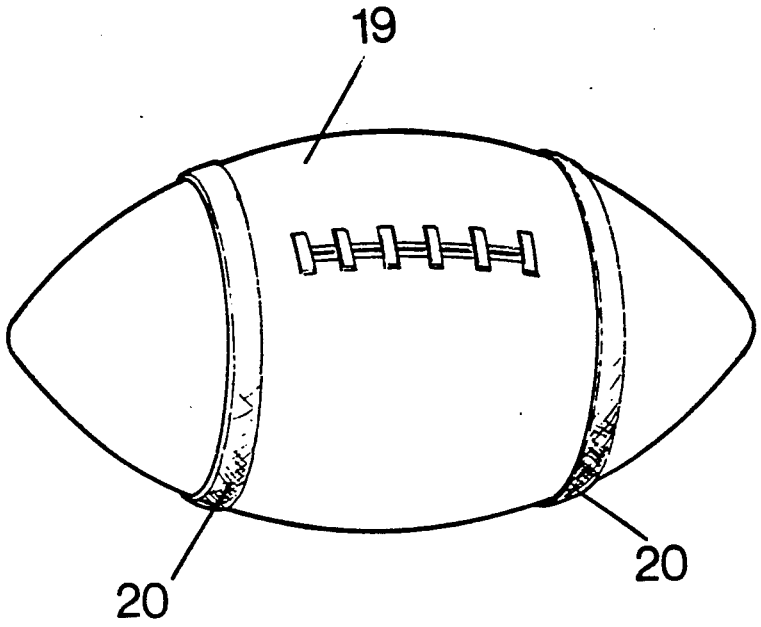
FIG. 3 illustrates the football of the invention with two bands of VELCRO.

Referring now to FIG. 3, a football 19 modified in accordance with the invention is illustrated. The football 19 bears two bands of VELCRO 20 around its surface. The bands 20 can be 0.125 to 0.5 inches wide. The bands 20 can be affixed to a footballs surface using strong adhesive or can be sewn onto the outer surface. The VELCRO 20 is a material which is available as coacting fabrics, one fabric having a plurality of fabric hooks across its surface, and the coacting fabric having a plurality of loops across its surface. When pressed or placed together, the hooks of one fabric become intertwined with the loops of the other fabric, thus providing a significant adhesion between the fabrics.

The hook fabric can also be used with fabrics other than the coacting VELCRO loop fabric. Examples of such are textured or napped fabrics such as tricot, wool or cotton flannel.

The choice of the hook and coacting fabrics and the engaging surface areas of the fabrics are selected to provide an adhesion between said hook fabric and said coacting fabric does not exceed two pounds of tear strength. When the aforementioned VELCRO fabrics are used, this contact surface area between said hook fabric and said coacting fabric should not exceed approximately two square inches to provide the optimum adhesion.

Figure 4:
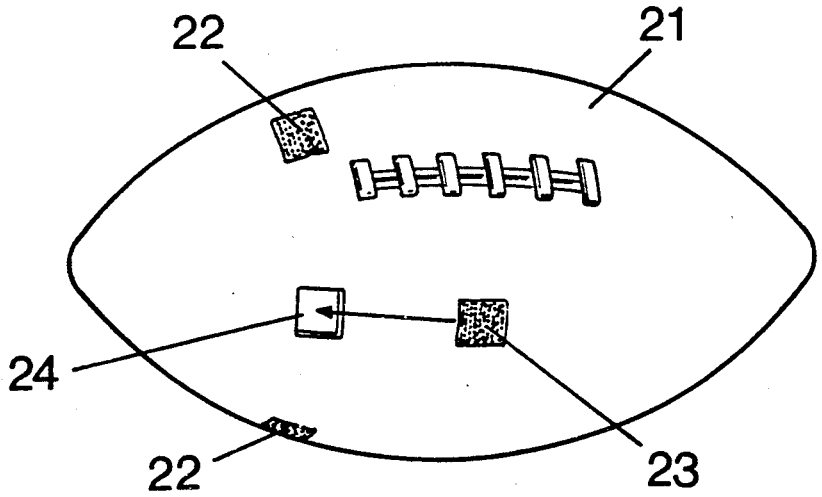
FIG. 4 illustrates the football of the invention with individual tabs of VELCRO on its surface.

FIG. 4 illustrates an alternative football 21 bearing individual patches of VELCRO material 22 on its outer surface. The patches can be 0.25×0.25 inches or as large as 0.75×0.75 inches. The size of the VELCRO patches is relative to the grip force of the particular VELCRO employed.

Throughout all embodiments of the invention disclosed herein the application of VELCRO hook and loop material, or of VELCRO and coacting napped fabric material should be controlled so that the grip strength between the coacting materials is no greater than is necessary to cause spiraling upon release. This amount of grip strength is no greater than two pounds of static pull, and preferably is no greater than one pound of static pull. This can be assured by controlling the VELCRO amount on one or both of the two coacting surfaces, or by using a coacting napped fabric having slightly lesser adhesion, e.g., wool or tricot.

These patches can be glued directly to the outer surface as described in FIG. 4. Preferably, in the case where the football is a toy and comprised of a soft foam, such as used in Parker Brothers NERF line of products, the object can be molded with recesses 24 corresponding in size and shape to the VELCRO patch 23. This results in the VELCRO patch 23 being glued into the recess 24, resulting in a stronger and more stable bond than mere surface affixation. It should be noted that the VELCRO bands shown in FIG. 3 can also be affixed to a football molded with corresponding recessed grooves on its outer surface.

Figure 5:
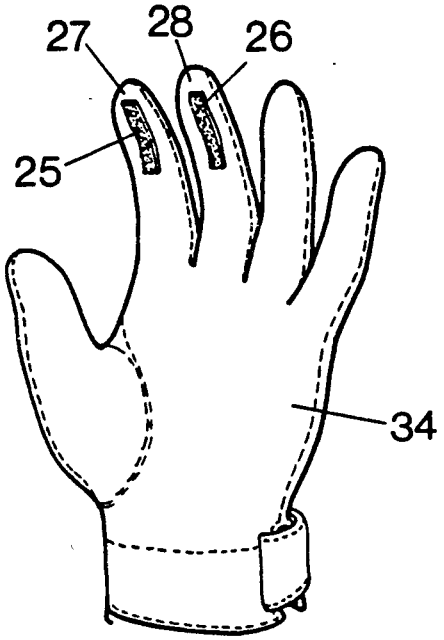
FIG. 5 illustrates a glove with VELCRO tabs on its fingers.

FIG. 5 illustrates a glove 34 of the invention. The glove 34 can be of vinyl or leather, and styled like a baseball batting glove, or like gloves currently worn by some football players. Fingertips 27 and 28, (the forefinger and middle finger, respectively), on the glove have VELCRO patches 25 and 26 affixed to them, either by stitching or by adhesive. The patches can vary in size, but can be 0.25" by 0.75" long. The VELCRO material on the glove should coact with the VELCRO on the football. One of the items, either the glove or the object should bear the hook VELCRO, while the other bears the loop VELCRO. It should be further noted that the invention will work with only one VELCRO tab, either 25 or 26.

Figure 6:
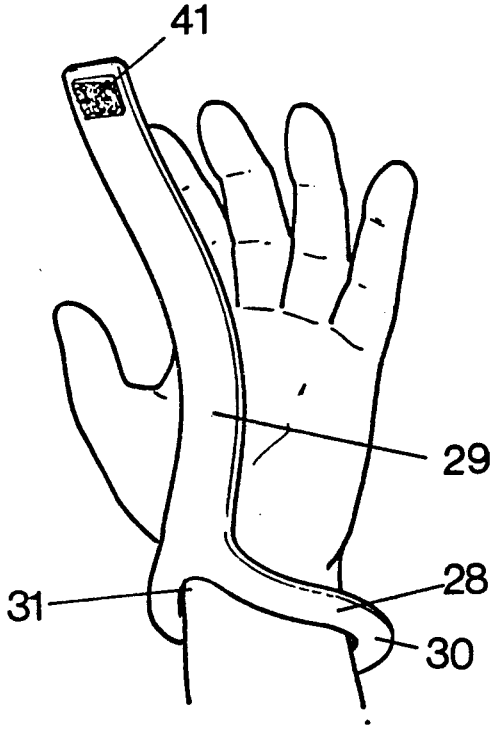
FIG. 6 illustrates an alternative wrist strap with a VELCRO tab.

FIG. 6 illustrates a wrist strap 28 which is an alternative to the glove 34. The wrist strap 28 can be die-cut from one piece of vinyl. The strap comprises a ring 30 that loops about in the wearer's wrist and for this purpose a hole 31 is provided through which the wearer places his hand, and a strap extension 29. The strap extension 29 should be long enough to terminate at or above the wearer's fingertips. At the top of the strap 29 is affixed a VELCRO patch 41, that can be 0.25" by 0.75" long.

Figure 7:
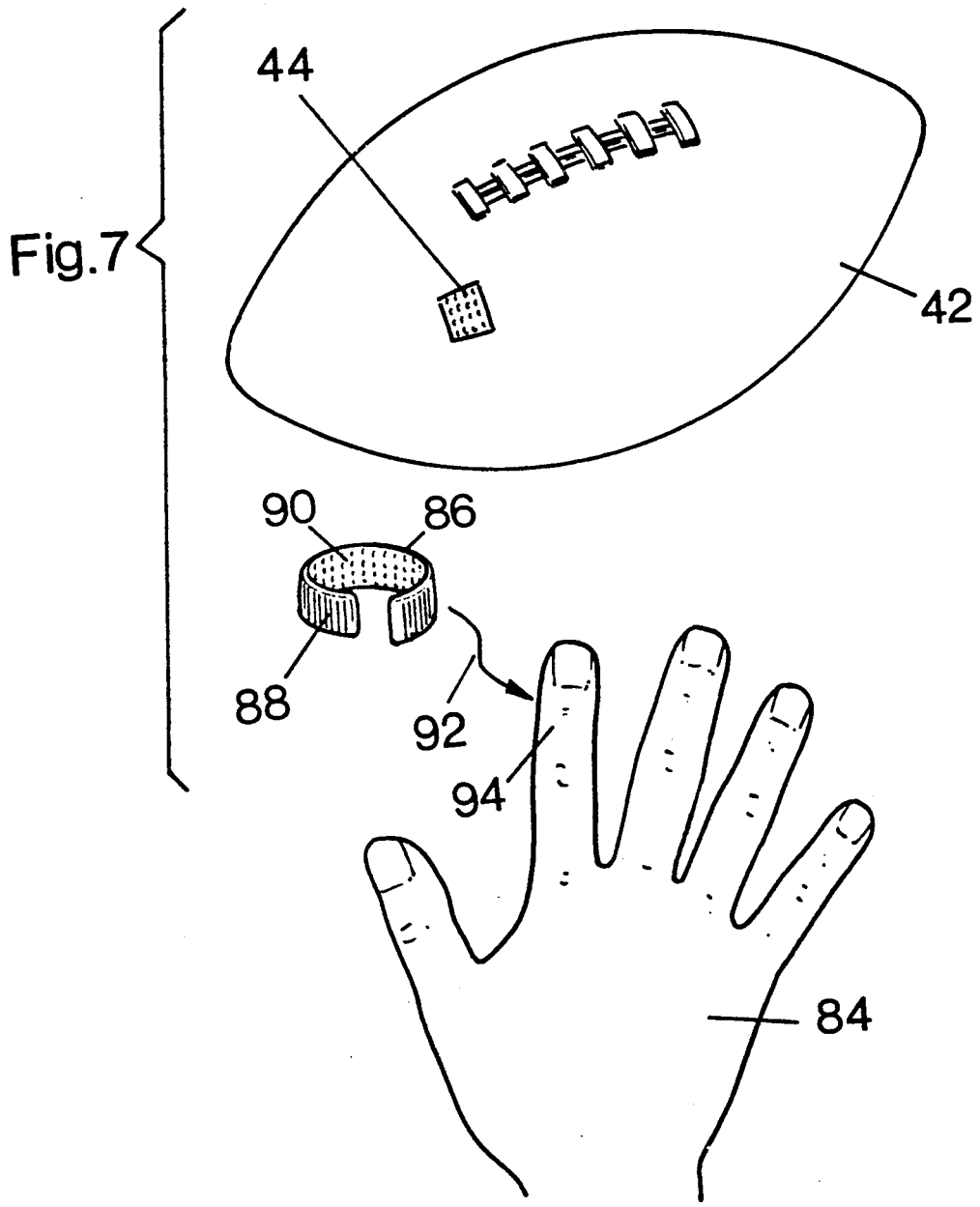
FIG. 7 illustrates an alternative finger-worn band comprised of VELCRO.

Referring now to FIG. 7, it can be seen that the football 42 has a VELCRO material 44 on its outer surface. A small VELCRO band 88 is comprised of both VELCRO materials. The inner surface 90 can have the loop design material, while the outer surface 88 bears the coacting hook design material. The child can wrap the band 86 around his finger 94 as shown by arrow 92, so that the end of the outer surface 88 co-acts with the inner surface 90, thereby securing the band around the finger. The outer surface 88 can now coact with the VELCRO tab 44 on the football 42 or FRISBEE (not shown) to cause spiralling as described throughout this patent application.

Figure 8:
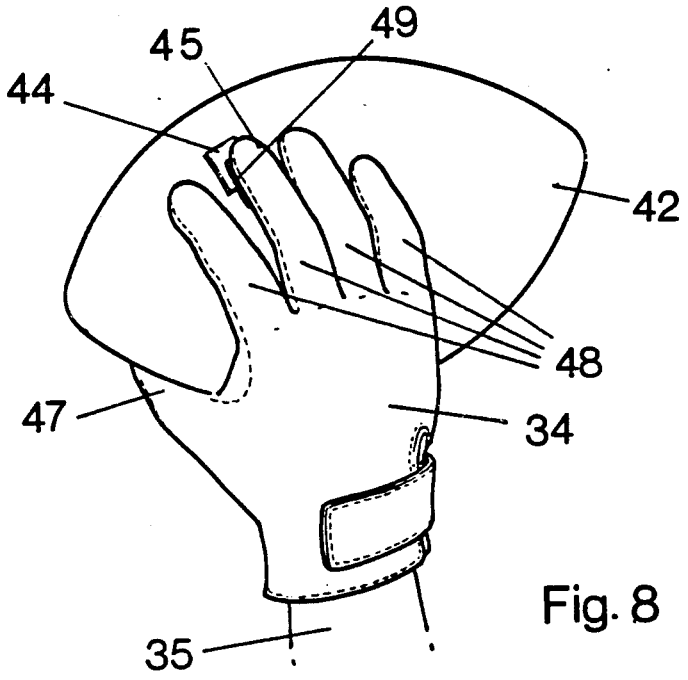
FIG. 8 illustrates a glove and football of the invention.

FIG. 8 illustrates a person's arm 35 holding the football 42 and preparing to throw. Glove 34 is on the person's hand. His fingers 48 and thumb 47 are holding the object in a manner similar to FIG. 1. Fingertip 45 on glove 34 bears a VELCRO patch 49 that is coacting with VELCRO patch 44 on football 42.

Figure 9:
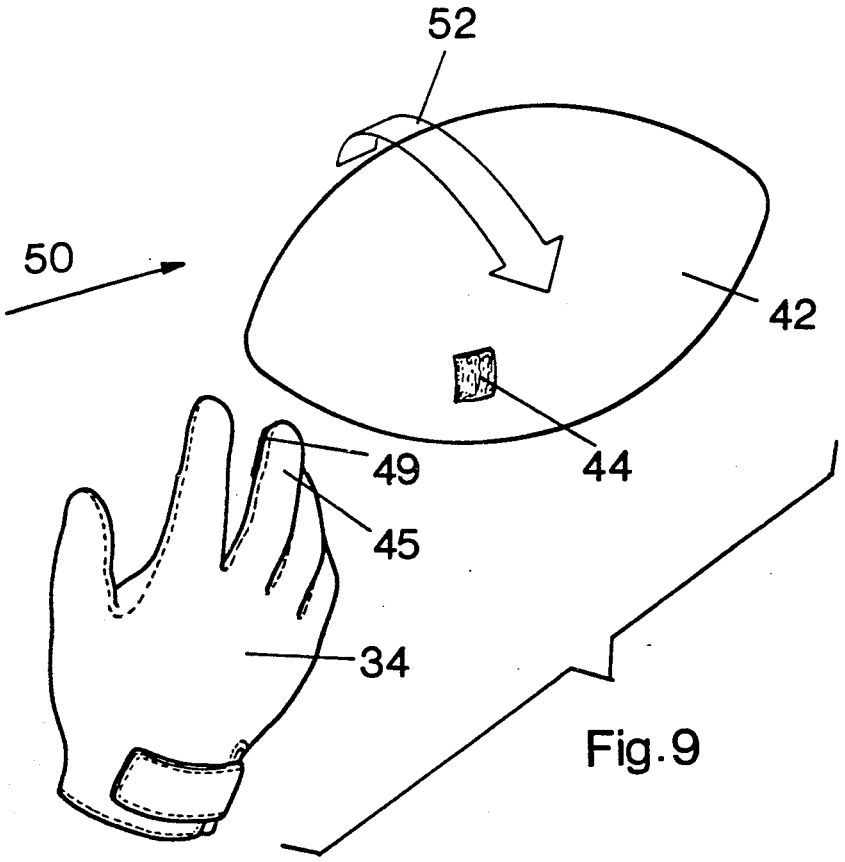
FIG. 9 illustrates throwing the football of the invention.

FIG. 9 illustrates the throw. As the object 42 is thrown in direction illustrated by arrow 50, the glove 34 releases the object 42. However, because the VELCRO material 49 on the fingertip 45 co-acts with the VELCRO patch 44 on the object 42, the downward motion of the thrower's hand causes the object 42 to start spinning, as illustrated by arrow 52.

Figure 10:
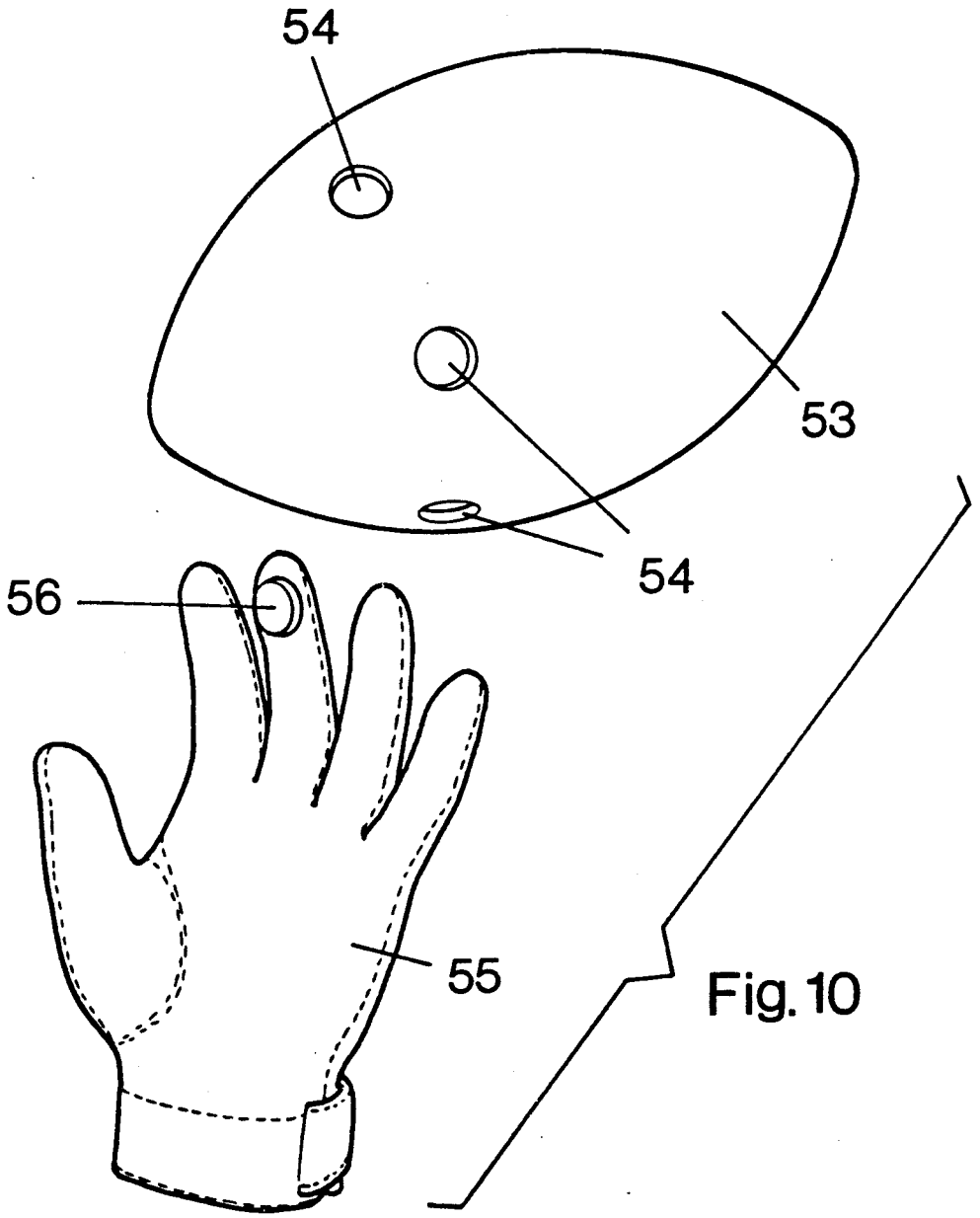
FIG. 10 illustrates an alternative to the VELCRO material used in the invention.

FIG. 10 illustrates a football 53 that is molded of plastic foam or similar material and has molded recesses 54 positioned on its outer surface. The thrower, not shown, wears a glove 55 or a strap similar to the strap described in FIG. 6; except that the glove 55 (or strap) has a slight bump 56 molded into the surface. The coaction of the bump into one of the recesses 54 will cause the object to spiral upon release, in a manner similar as to described elsewhere herein. It should be noted that the bumps could be molded onto the object surface, and the detent molded into the glove or strap. It should also be noted that, although not as easy to use, the object with molded detents can be thrown by a person positioning a fingertip into one of the molded holes, thereby causing a spiral action as the object is released from his hand. In this instance, the wearer does not wear a glove or strap.

FIGS. 11–13 illustrate a glove 60 which is used with the football of the invention. FIG. 11 illustrates how the glove fits the wearer's hand 61. The glove has only two fingers, 62 and 63, for the index and middle finger of the throwing hand of a player. The fingers 62 and 63 of the glove 60 each have a VELCRO tab 64 and 65 on the inside surface of the fingers, and the fingers are attached to a strap 66 which lies across the palm of the hand to a wrist band 67. The wrist band 67 encircles the player's wrist 68 and has a pair of coacting VELCRO tabs 69 and 70 at each end of the band.

As shown in FIG. 12, the wrist band 67 closes over the back of the player's wrist 68, securing the glove 60 in position. The two fingers 62 and 63 totally cover the players index and middle finger, as apparent from FIGS. 11 and 12.

The invention can be used with other objects which are to be thrown with a spin, such as a FRISBEE. FIG. 13 illustrates a FRISBEE 76 which typically is a flat circular disc 78 molded of light weight plastics. The FRISBEE usually has a flat top disc 78 with a dependent skirt 80 of limited width. VELCRO patches 82 are applied onto the skirt 80, preferably at evenly spaced intervals. Alternatively, the skirt 80 can be entirely covered with a continuous band 84 of VELCRO fabric, such as shown in FIG. 15.

Figure 14:
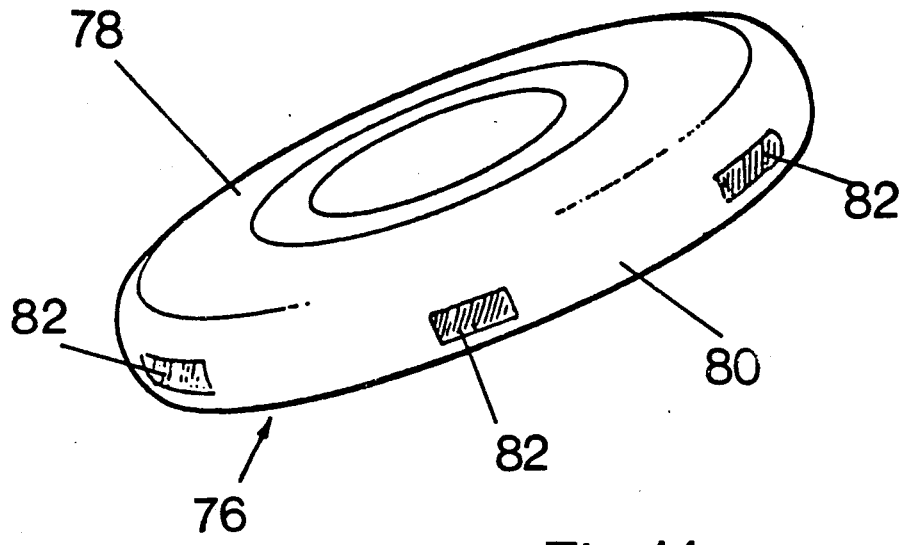
FIG. 14 illustrates a FRISBEE modified in accordance with the invention.
Figure 15:
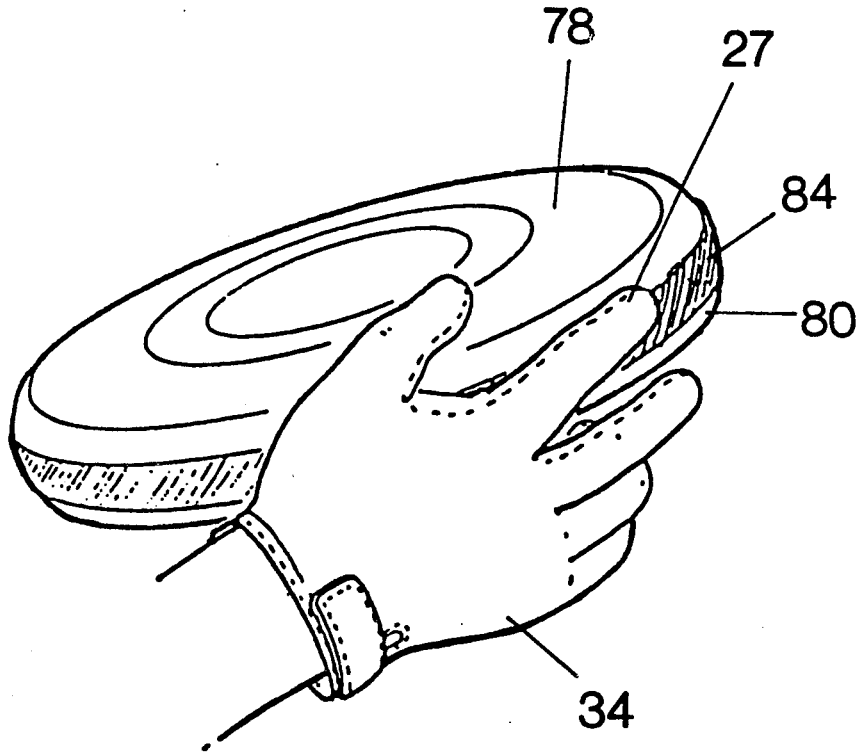
FIG. 15 illustrates the throwing of a FRISBEE modified in accordance with the invention.

The throwing of the FRISBEE is shown in FIG. 15, with the player wearing a glove 34, such as that shown in FIGS. 5, 8 and 9. In this throwing action, the grasps the Frisbee in the normal fashion, with the FRISBEE opposite the palm of the thrower's hand, and with the index finger 27 resting against the cylindrical skirt 80. This places the mating VELCRO patch 25 (see FIG. 5) against the VELCRO band 84 (or patch 82 in FIG. 14), and when the FRISBEE is thrown, the tug of the Velcro mating fabrics will impart the desired spin to the FRISBEE. Although the FRISBEE is shown in use only with the glove of FIG. 5, it is apparent that the partial glove shown in FIGS. 6 and 11–13, or the finger band shown in FIG. 7, could also be used.

The invention provides a surprisingly high degree of control to players throwing objects such as a football or FRISBEE. The objects can be thrown further and with greater accuracy using the invention because even novice players quickly adapt and can throw perfect spiral passes with a football. With use of the invention, players also learn the proper throwing action for a football, and more quickly acquire the skill necessary to throw spirl passes with even unmodified footballs. The degree of adhesion, or tug, on the object as it is released can be controlled by adjusting the area of one or both of the VELCRO fabrics on the object and the glove. This can be achieved, for instance, by reducing the size of the VELCRO patch, such as 27 or 28 on the glove 34, as the player acquires skill and experience in throwing the object. When used as a training aid, the size of the VELCRO patch on the player's glove can be progressively decreased, until the thrower is able to master spinning the object without the use of any VELCRO. Because the invention provides for quick mastery over throwing a football, children and youths find the task pleasant and enjoyable, and become more likely to continue practicing throwing rather than giving up in frustration before mastering the correct throwing action. Accordingly, the invention also functions as a training aid to develop the throwing skills of children and athletes.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims.

What is claimed is:

1. The combination of an airborne, untethrered, throwing projectile and a throwing aid therefor which comprises:

a receptor site located on the surface of said airborne throwing projectile in the area thereof which is grasped by a thrower; and a throwing aid worn on the throwing hand, wrist or finger of a thrower of the object and including at least one distal covering bearing a mating surface which adheres to the receptor site on the outer surface of said airborne throwing projectile.

2. The combination of claim 1 wherein said receptor site comprises at least one recess in the outer surface of said object.

3. The combination of claim 2 wherein said mating surface is a protrusion having the size and shape to fit within said recess.

4. The combination of claim 3 wherein said throwing aid is a glove and wherein said protrusion is distally located on one or both of the index and middle finger of said glove.

5. The combination of claim 1 wherein both of said receptor site and mating surface are fabrics; one being a hook fabric, and the other a coacting fabric.

6. The combination of claim 5 wherein the grip strength between said hook fabric and said coacting fabric does not exceed two pounds of tear strength.

7. The combination of claim 6 wherein said throwing aid is a glove having at least a finger for at least one of the index finger and middle fingers of the wearer and including one of said fabrics distally located on said at least one finger.

8. The combination of claim 7 wherein one of said fabrics is distally located on both said index and middle fingers of said glove.

9. The combination of claim 7 wherein said throwing aid is a complete glove.

10. The combination of claim 5 wherein said receptor site on the throwing object is a tricot material that coacts with a hook fabric on the throwing aid.

11. The combination of claim 5 wherein said fabrics are coacting Velcro® fabrics.

12. The combination of claim 11 wherein the contact surface area between said coating Velcro® fabrics does not exceed two square inches.

13. The combination of claim 11 wherein said throwing aid is a glove having at least a finger for at least one of the index finger and middle fingers of the wearer and including one of said fabrics distally located on said at least one finger.

14. The combination of claim 13 wherein one of said fabrics is distally located on both said index and middle fingers of said glove.

15. The combination of claim 13 wherein said throwing aid is a complete glove.

16. The combination of claim 1 wherein both of said receptor site and mating surface are fabric patches; one of said fabrics being a hook fabric, and the other being a coacting fabric.

17. The combination of claim 16 wherein said throwing object is a football, and said fabric patch receptor site is located lightly displaced from the midline of the football.

18. The combination of claim 17 wherein said receptor side comprises a plurality of patches of said one of said fabrics carried slightly displaced from the midline of the football in the area which is grasped by the index and middle finger of a thrower of the football.

19. The combination of claim 17 wherein said fabric receptor site comprises at least one continuous band of said Velcro fabric encircling said football at a location slightly displaced from the midline of the football in the area which is grasped by the index and middle finger of a thrower of the football.

20. The combination of claim 16 including at least one recess in the surface of said throwing object with said fabric patch received within and filling said recess.

21. The combination of claim 16 wherein said throwing object is a Frisbee® having a circular disc with a dependent cylindrical skirt, and said fabric patch receptor site is located on the outside wall of said skirt.

22. The combination of claim 21 wherein said receptor site comprises a plurality of patches of said fabric evenly spaced on said cylindrical wall.

23. The combination of claim 21 wherein said receptor site comprises a band of said fabric on and coextensive with said cylindrical wall.

24. The combination of a football and a throwing aid therefor which comprises:

a receptor site located on the surface of said football in an area slightly displaced from the midline of the football which is grasped by a thrower of the football; and a throwing aid worn on the throwing hand, wrist or finger of a thrower of the object and including at least one distal covering bearing a mating surface which adheres to the receptor site on the outer surface of said football.

25. The combination of a flying disc toy having a cylindrical skirt, and a throwing aid therefor which comprises:

a receptor site located on the cylindrical skirt of said flying disc toy; and a throwing aid worn on the throwing hand, wrist or finger of a thrower of the object and including at least one distal covering bearing a mating surface which adheres to the receptor site on the outer surface of said object.

26. The combination of a throwing object and a throwing aid therefor which comprises:

a receptor site of a first fabric located on the surface of said throwing object in the area thereof which is grasped by a thrower; and a throwing aid comprising a band having a loop at one end thereof which encircles the wrist of a thrower and having a second fabric distally located at the opposite end thereof which adheres to said first fabric of said receptor site, with one of said first and second fabrics being a hook fabric and the other a coacting fabric with the grip strength between said hook fabric and said coacting fabric not exceeding two pounds of tear strength.

27. The combination of a throwing object and a throwing aid therefor which comprises:

a receptor site of a first fabric located on the surface of said throwing object in the area thereof which is grasped by a thrower; and a throwing aid comprising a small band which encircles a finger of said thrower and having a second fabric located on said band which adheres to said first fabric of said receptor site, with one of said first and second fabrics being a hook fabric and the other a coacting fabric with the grip strength between said hook fabric and said coacting fabric not exceeding two pounds of tear strength.

28. The combination of a throwing object and a throwing aid therefor which comprises:

a receptor site of a first Velcro® fabric located on the surface of said throwing object in the area thereof which is grasped by a thrower; and a throwing aid having a band having a loop at one end thereof which encircles the wrist of a thrower and having a second Velcro® fabric which adheres to said first Velcro® fabric of said receptor site distally located at the opposite end thereof.

29. The combination of a throwing object and a throwing aid therefor which comprises:

a receptor site of a first Velcro® fabric located on the surface of said throwing object in the area thereof which is grasped by a thrower; and a throwing aid having a small band which encircles a finger of said thrower and having a second Velcro® fabric which adheres to said first Velcro® fabric of said receptor site located on said band.

* * * * *